US010236564B2

(12) United States Patent
Erentok et al.

(10) Patent No.: US 10,236,564 B2
(45) Date of Patent: Mar. 19, 2019

(54) WEARABLE ELECTRONIC DEVICE WITH DETACHABLE ANTENNA SUPPORT

(71) Applicant: Intel Corporation, Santa Clara, CA (US)

(72) Inventors: Aycan Erentok, Sunnyvale, CA (US); David Niemira, Santa Clara, CA (US); Eagan Wilson, Santa Clara, CA (US); Thomas H. Liu, Fremont, CA (US)

(73) Assignee: Intel Corporation, Santa Clara, CA (US)

( * ) Notice: Subject to any disclaimer, the term of this patent is extended or adjusted under 35 U.S.C. 154(b) by 64 days.

(21) Appl. No.: 15/221,412

(22) Filed: Jul. 27, 2016

(65) Prior Publication Data

US 2018/0034136 A1 Feb. 1, 2018

(51) Int. Cl.

| | |
|---|---|
| ***H01Q 1/27*** | (2006.01) |
| ***H01Q 1/22*** | (2006.01) |
| ***H01Q 1/24*** | (2006.01) |
| ***H01Q 1/48*** | (2006.01) |
| ***H01Q 21/28*** | (2006.01) |

(52) U.S. Cl.
CPC ..... *H01Q 1/273* (2013.01); *H01Q 1/2291* (2013.01); *H01Q 1/241* (2013.01); *H01Q 1/48* (2013.01); *H01Q 21/28* (2013.01)

(58) Field of Classification Search
CPC ..... H01Q 1/2291; H01Q 1/241; H01Q 1/273; H01Q 1/48; H01Q 21/28
See application file for complete search history.

(56) References Cited

U.S. PATENT DOCUMENTS 5,007,105 A * 4/1991 Kudoh ..... G08B 5/228 340/407.1
5,926,144 A * 7/1999 Bolanos ..... G04B 47/025 343/718
7,848,180 B2 * 12/2010 Someya ..... H01Q 1/364 343/725

(Continued)

OTHER PUBLICATIONS

International Search Report and Written Opinion dated Sep. 22, 2017 issued in related International Application No. PCT/US2017/037036, 13 pages.

(Continued)

*Primary Examiner* — Tho G Phan
(74) *Attorney, Agent, or Firm* — Schwabe, Williamson & Wyatt, P.C.

(57) ABSTRACT

Embodiments herein relate to the detection and switchable use of a detachable GNSS antenna with a wearable electronic device. In various embodiments, a wearable electronic apparatus may include a multi-band antenna to receive satellite positioning signals in a first frequency band and local radio frequency communication signals in a second frequency band, an antenna connector to optionally receive a detachable satellite positioning antenna, and a switch having a switching terminal, a first input terminal coupled with the multi-band antenna, a second input terminal coupled with the antenna connector, and an output terminal, wherein the switch is to selectively connect the first input terminal or the second input terminal to the output terminal, in response to a state of a switching signal received at the switching terminal. Other embodiments may be described and/or claimed.

9 Claims, 4 Drawing Sheets

(56) References Cited

U.S. PATENT DOCUMENTS

| | | | | |
|---|---|---|---|---|
| 8,305,270 | B2 | 11/2012 | Waters et al. | |
| 8,315,126 | B2 * | 11/2012 | Someya | H01Q 9/04 368/47 |
| 9,160,064 | B2 | 10/2015 | Ferguson | |
| 2007/0142001 | A1 | 6/2007 | Sanders | |
| 2008/0036681 | A1 | 2/2008 | Caesar | |
| 2009/0121932 | A1 | 5/2009 | Whitehead et al. | |
| 2011/0054729 | A1 | 3/2011 | Whitehead et al. | |
| 2012/0229349 | A1 | 9/2012 | Badaruzzaman et al. | |
| 2013/0078926 | A1 | 3/2013 | Bouillet | |
| 2014/0148095 | A1 | 5/2014 | Smith et al. | |
| 2016/0065247 | A1 | 3/2016 | Kim et al. | |

OTHER PUBLICATIONS

Bliss, D.,W. "Multiple-Antenna Techniques for Wireless Communications," Tech Notes, MIT Lincoln Laboratory, Sep. 2008.

* cited by examiner

WEARABLE ELECTRONIC DEVICE WITH DETACHABLE ANTENNA SUPPORT

FIELD

Embodiments of the present disclosure generally relate to the field of wearable electronic devices and, more particularly, to wearable electronic devices with detachable antenna support.

BACKGROUND

Wearable electronic devices such as head or wrist-worn devices have been shown to benefit professionals with certain enterprise applications and consumers seeking to enhance their experiences in various sport activities. The wearable electronic devices may provide live data to a user with respect to their speed, cumulative distance, altitude, and other parameters during their running, cycling, skiing, and other sport activities. Typically, signals from a global navigation satellite system (GNSS) are used to support collection or generation of the live data often by post-processing the GNSS signals with internal sensors. Local radio frequency (RF) communication techniques such as Bluetooth (BT) connectivity is typically used to provide connectivity between the wearable electronic device and a nearby host device such as a smart phone and may enable additional functionality such as listening to music stored on the host device using the wearable electronic device or by enabling wireless data transfer between the wearable electronic device and the host device. In order to maintain a streamlined profile for the wearable electronic device, an integrated multi-band antenna may be used that does not function well for GNSS signal reception in some outdoor environments. While the low profile of the integrated antenna provides a desirable streamlined design, it may unduly compromise functionality in some situations.

BRIEF DESCRIPTION OF THE DRAWINGS

Embodiments of the detachable GNSS antenna connection and detection, as well as GNSS signal switching techniques of the present disclosure may overcome these limitations. The techniques will be readily understood by the following detailed description in conjunction with the accompanying drawings. To facilitate this description, like reference numerals designate like structural elements. Embodiments are illustrated by way of example, and not by way of limitation, in the figures of the accompanying drawings.

DETAILED DESCRIPTION

Figure 1:
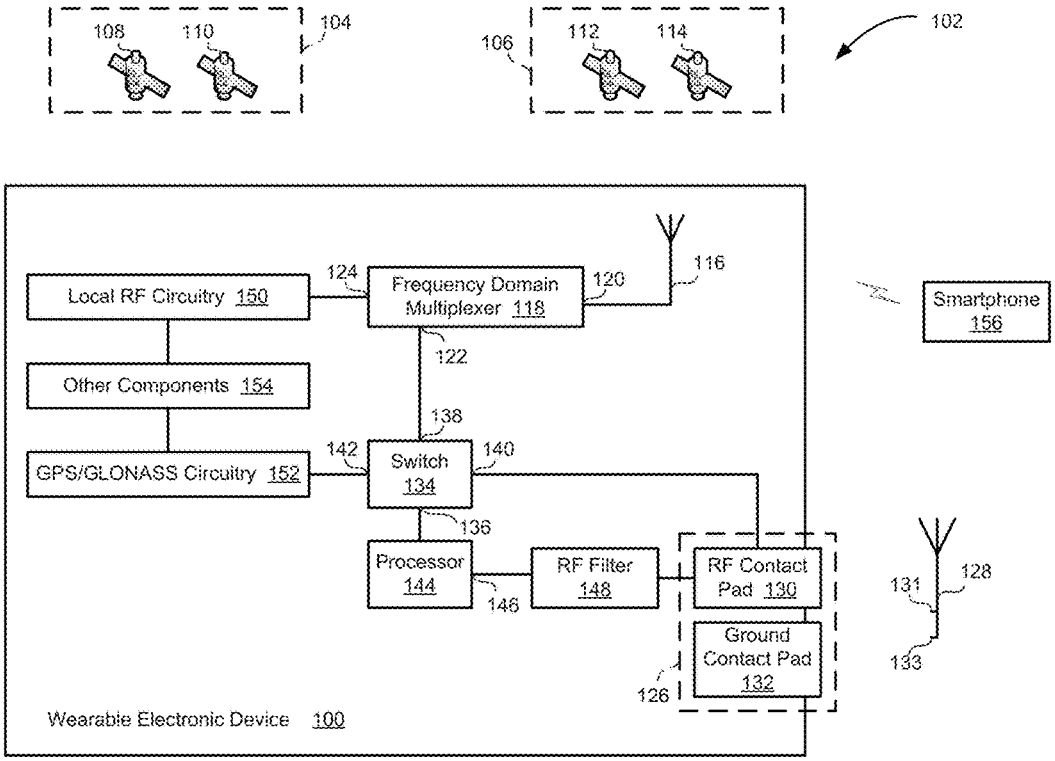
FIG. 1 is a block diagram of a wearable electronic apparatus having a global navigation satellite system (GNSS) antenna switch in a GNSS operating environment, according to various embodiments.

Embodiments of the present disclosure describe devices, systems, and techniques that allow for connection of a detachable global navigation satellite system (GNSS) antenna to a wearable electronic device when better GNSS reception characteristics are needed than a streamlined internal multi-band antenna may provide, while providing for continuous Bluetooth and/or WiFi connectivity during connection and disconnection of the detachable antenna. In various embodiments, a wearable electronic apparatus may include a multi-band antenna to receive satellite positioning signals in a first frequency band and local radio frequency (RF) communication signals in a second frequency band; an antenna connector to optionally receive a detachable satellite positioning antenna; and a switch configured to selectively couple to the multi-band antenna or the detachable satellite positioning antenna, depending on whether the detachable satellite positioning antenna is received in the antenna connector. In embodiments, the wearable electronic apparatus may further include a detector coupled with the switch to detect whether the detachable antenna is attached to the antenna connector and generate a switching signal that directs the switch to selectively couple GNSS signals from the multi-band antenna or the detachable antenna to an output terminal for use by the wearable electronic device.

In the following description, various aspects of the illustrative implementations will be described using terms commonly employed by those skilled in the art to convey the substance of their work to others skilled in the art. However, it will be apparent to those skilled in the art that embodiments of the present disclosure may be practiced with only some of the described aspects. For purposes of explanation, specific numbers, materials, and configurations are set forth in order to provide a thorough understanding of the illustrative implementations. It will be apparent to one skilled in the art that embodiments of the present disclosure may be practiced without the specific details. In other instances, well-known features are omitted or simplified in order not to obscure the illustrative implementations.

In the following detailed description, reference is made to the accompanying drawings that form a part hereof, wherein like numerals designate like parts throughout, and in which is shown by way of illustration embodiments in which the subject matter of the present disclosure may be practiced. It is to be understood that other embodiments may be utilized and structural or logical changes may be made without departing from the scope of the present disclosure. Therefore, the following detailed description is not to be taken in a limiting sense, and the scope of embodiments is defined by the appended claims and their equivalents.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B, and C).

The description may use perspective-based descriptions such as top/bottom, in/out, over/under, and the like. Such descriptions are merely used to facilitate the discussion and are not intended to restrict the application of embodiments described herein to any particular orientation.

The description may use the phrases "in an embodiment," or "in embodiments," which may each refer to one or more of the same or different embodiments. Furthermore, the terms "comprising," "including," "having," and the like, as used with respect to embodiments of the present disclosure, are synonymous.

The term "coupled with," along with its derivatives, may be used herein. "Coupled" may mean one or more of the following. "Coupled" may mean that two or more elements are in direct physical or electrical contact. However, "coupled" may also mean that two or more elements indirectly contact each other, but yet still cooperate or interact with each other, and may mean that one or more other elements are coupled or connected between the elements that are said to be coupled with each other. The term "directly coupled" may mean that two or more elements are in direct contact.

As used herein, the term "module" may refer to, be part of, or include an Application Specific Integrated Circuit (ASIC), an electronic circuit, a processor (shared, dedicated, or group), and/or memory (shared, dedicated, or group) that execute one or more software or firmware programs, a combinational logic circuit, and/or other suitable components that provide the described functionality.

FIG. 1 is a block diagram of a wearable electronic device 100 in a GNSS operating environment 102, according to various embodiments. In some embodiments, the GNSS operating environment 102 may include a first global navigation satellite system 104 such as a global positioning system (GPS) and a second global navigation satellite system 106 such as the global navigation satellite system (GLONASS) operated by Russia. In various embodiments, the first global navigation satellite system 104 may include a plurality of GPS satellites such as a first GPS satellite 108 and a second GPS satellite 110. In some embodiments, the second global navigation satellite system 106 may include a plurality of GLONASS satellites such as a first GLONASS satellite 112 and a second GLONASS satellite 114. In various embodiments, the wearable electronic device 100 may receive satellite positioning signals from the first global navigation satellite system 104 and/or the second global satellite navigation system 106. In some embodiments, other GNSS systems and/or additional GNSS systems may be included in the GNSS operating environment 102. Although two satellites are shown in each of the first global navigation satellite system 104 and the second global navigation satellite system 106 for clarity, it should be understood that the global navigation satellite systems may include a different number of satellites in various embodiments and signals may be received by the wearable electronic device 100 from more than two satellites in each system.

In some embodiments, the wearable electronic device 100 may include an integrated multi-band antenna 116 to receive satellite positioning signals, such as GPS signals from the first GNSS 104 and/or GLONASS signals from the second GNSS 106, in a first frequency band and local RF signals in a second frequency band. In some embodiments, the wearable electronic device 100 may receive satellite positioning signals from GNSS systems in addition to or instead of GPS and/or GLONASS. In various embodiments, the local RF signals may include Bluetooth (e.g., Bluetooth Low Energy (BLE)) and/or WiFi signals. In some embodiments, the first frequency band may be a 2.4 to 2.48 gigahertz (GHz) frequency band for local RF communication and/or the second frequency band may include frequencies for both GPS and GLONASS signal reception in the 1559-1610 megahertz (MHz) range. In various embodiments, other frequency bands and/or additional frequency bands may be used.

In some embodiments, the wearable electronic device 100 may include a frequency domain multiplexer 118, such as a diplexer, coupled with the multi-band antenna 116 at a first port 120 to multiplex signals from the first frequency band to a second port 122 and signals from the second frequency band to a third port 124. In various embodiments, the wearable electronic device 100 may be a wrist-worn device. In some embodiments, the wearable electronic device 100 may be a head-worn device, or be configured for wearable use on another portion of a user's body such as the torso or foot, for example.

In various embodiments, the wearable electronic device 100 may include an antenna connector 126 to receive a detachable satellite positioning antenna 128. In some embodiments, the detachable satellite positioning antenna 128 may be configured such that it is integrated in and/or also serves as a securing component of the wearable electronic device 100, such as being included in a detachable wrist band for a wrist-worn device, for example. In some embodiments, the antenna connector 126 may include an RF contact pad 130 and a ground contact pad 132. In some embodiments, the RF contact pad 130 and the ground contact pad 132 may be configured in an open circuit at direct current (DC) frequency when the detachable satellite positioning antenna 128 is not connected. In various embodiments, the detachable satellite positioning antenna 128 may include a first connection point 131 and a second connection point 133 that may be coupled with the RF contact pad 130 and the ground contact pad 132, respectively, when the antenna 128 is coupled with the antenna connector 126. In some embodiments, the antenna 128 may be an F-antenna, an inverted F-antenna, or some other type of antenna having two connection points. In some embodiments, the detachable satellite positioning antenna 128 and the antenna connector 126 may each be configured such that when the detachable satellite positioning antenna 128 is coupled with the antenna connector 126, a short circuit at DC frequency is formed between the RF contact pad 130 and the ground contact pad 132. In various embodiments, the detachable satellite positioning antenna 128 may support a right hand circularly polarized radiation pattern with upper hemisphere antenna gain to receive low level GNSS signals in the −130 dBm range and may include the ability to receive signals from multiple satellites. In some embodiments, use of the detachable satellite positioning antenna 128 may allow for more streamlined use and/or improved aesthetics of the wearable electronic device 100 when the detachable satellite positioning antenna 128 is not needed, while providing better reception when used. In various embodiments, use of the detachable satellite positioning antenna 128 may also improve de-sensing as a result of the detachable antenna being placed farther away from other hardware components of the wearable electronic device 100 than the integrated antenna 116. In some embodiments, the placement of the antenna 128 may further help to reduce the inherent electromagnetic (EM) losses due to a user's body.

In various embodiments, the wearable electronic device 100 may include a switch 134 having a switching terminal 136, a first input terminal 138, a second input terminal 140, and an output terminal 142. In some embodiments, the first input terminal 138 may be coupled with the multi-band antenna 116 and the second input terminal 140 may be coupled with the antenna connector 126. In various embodiments, the first input terminal 138 may be indirectly coupled with the multi-band antenna 116 via the frequency domain multiplexer 118 which may be coupled with the multi-band antenna 116 at the first port 120, with the first input terminal 138 of the switch 134 coupled with the second port 122 of the frequency domain multiplexer 118. In some embodiments, the switch 134 may be a single-pole double-throw RF switch. In various embodiments, the switch 134 may be another type of RF switch.

In various embodiments, a detector, such as a processor 144, may be coupled with the switching terminal 136 of the switch 134. In some embodiments, the processor 144 may be coupled with the antenna connector 126 at a general purpose input/output (GPIO) terminal 146. In various embodiments, the processor 144 may be indirectly coupled with the antenna connector 126, as shown, via a RF filter 148 that may filter a signal from the antenna connector 126 before it is received by the processor 144. In various embodiments, the RF filter 148 may pass or block one or more predefined frequencies and/or frequency bands. In some embodiments, the RF filter 148 may be configured as a low pass filter to improve de-sense due to processor activities at GNSS frequencies. In some embodiments, the RF filter 148 may be used to further improve the radiation efficiency of the antenna 128. In some embodiments, the detector may be implemented in a different manner that may not use a processor and/or a GPIO terminal.

In some embodiments, local RF circuitry 150 may be coupled with the third port 124 of the frequency domain multiplexer 118 and/or GPS/GLONASS circuitry 152 may be coupled with the output terminal 142 of the switch 134. In various embodiments, the local RF circuitry 150 may include local RF (e.g., Bluetooth and/or Wifi) signal reception, signal transmission, and/or signal processing circuitry. In some embodiments, the GPS/GLONASS circuitry 152 may include GPS/GLONASS signal reception and/or signal processing circuitry. Other components 154 of the wearable electronic device 100 may be coupled with the local RF circuitry 150 and/or the GPS/GLONASS circuitry 152 in various embodiments. In some embodiments, the local RF circuitry 150 and/or the GPS/GLONASS circuitry 152 may be coupled with the processor 144, links not shown for clarity. In various embodiments, the other components 154 may include input devices, output devices, sensors, processors, memory, or other devices. In some embodiments, the local RF circuitry 150 and the GPS/GLONASS circuitry 152 may be included in one combined circuitry that may have designated input terminals for different RF signals (e.g., GPS/GLONASS and Bluetooth/WiFi RF signals).

In some embodiments, the wearable electronic device 100 may be in local RF communication (e.g., Bluetooth and/or WiFi) with another electronic device such as a smartphone 156. In various embodiments, local RF communication between the wearable electronic device 100 and the smartphone 156 may continue without interruption during coupling and/or decoupling of the detachable satellite positioning antenna 128 by using the integrated multi-band antenna 116 for local RF communication before, during, and after coupling and/or decoupling of the detachable satellite positioning antenna 128 and the wearable antenna connector 126. In some embodiments, the wearable electronic device 100 may be in local RF communication with a device such as wireless headphones in addition to, or instead of, the smartphone 156. In some embodiments, the local RF communication may allow for continuous streaming of content such as music from the wearable electronic device 100 to wireless headphones, or from a host device such as the smartphone 156 to the wearable electronic device 100. In various embodiments, the local RF communication may allow the wearable electronic device 100 to send control signals to the smartphone 156 or some other electronic device. Although not shown for clarity, it should be understood that the wearable electronic device 100 may include one or more circuit boards or other platforms on which one or more components (e.g., frequency domain multiplexer 118, switch 134, processor 144, RF filter 148, local RF circuitry 150, GPS/GLONASS circuitry 152, and/or other components 154) may be mounted and on and/or through which one or more signals may be routed.

Figure 2:
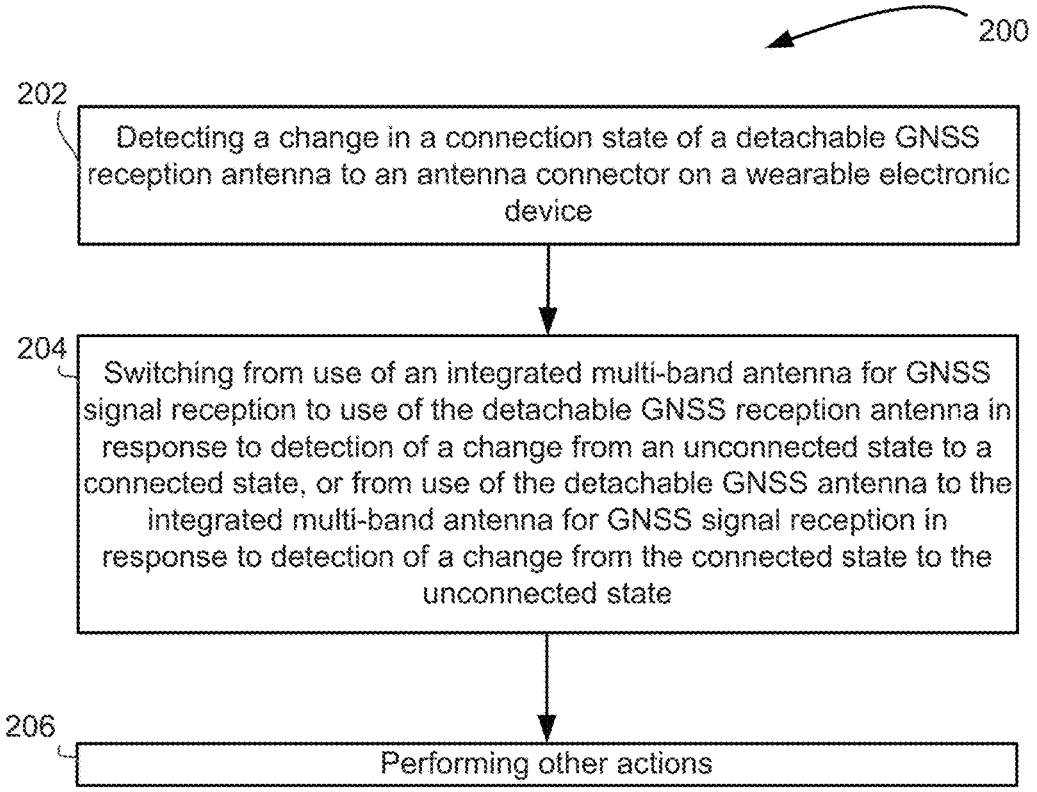
FIG. 2 is a flow diagram illustrating a method of switching between use of a multi-band antenna integrated with a wearable electronic device and use of a detachable GNSS reception antenna for GNSS signal reception, according to various embodiments.

FIG. 2 is a flow diagram illustrating a method 200 of switching between use of a multi-band antenna integrated with a wearable electronic device and use of a detachable GNSS reception antenna for GNSS signal reception, according to various embodiments. In embodiments, some or all of the method 200 may be practiced by components of the wearable electronic device 100, described with respect to FIG. 1.

In some embodiments, the method 200 may include detecting, by a wearable electronic device (e.g., wearable electronic device 100), a change in a connection state of a detachable GNSS reception antenna (e.g., detachable antenna 128) to an antenna connector (e.g., antenna connector 126) on the wearable electronic device at a block 202. In various embodiments, detecting the change in the connection state may include receiving a signal at a GPIO terminal of a processor (e.g., processor 144), where the processor is to periodically determine a current connection state of the detachable GNSS reception antenna based at least in part on the signal received at the GPIO terminal and generate a switch control signal based at least in part on the current connection state. In some embodiments, detecting a change from an unconnected state to a connected state of the detachable GNSS reception antenna may include detecting a change from an open circuit (e.g., large impedance) at DC frequency between a RF contact pad (e.g., RF contact pad 130) and a ground contact pad (e.g., ground contact pad 132) to a short circuit (e.g., low or zero impedance) at DC frequency between the RF contact pad and the ground contact pad. In some embodiments, the wearable electronic device 100 may not directly determine a change in the connection state, but may simply perform switching actions based at least in part on a current connection state of the detachable antenna 128.

In various embodiments, the method 200 may include switching, by the wearable electronic device, from use of an integrated multi-band antenna for GNSS signal reception to use of the detachable GNSS reception antenna for GNSS signal reception in response to detection of a change from an unconnected state to a connected state at a block 204. In various embodiments, the switching may occur in a variety of different manners. In some embodiments, the switch 134 may be coupled to the antenna connector 126 and may include a detector within the switch 134 that may generate a switching signal within the switch 134 based at least in part on whether the detachable satellite positioning antenna 128 is connected to the antenna connector 126, such that the switch 134 may perform the switching without need for reliance on a separate detector component such as the processor 144. In some embodiments, the antenna connector 126 may include a detector, and the antenna connector 126 may provide a switching signal to the switch 134 such that the switch 134 may perform the switching without receiving a switching signal from a separate detector such as the processor 144. In various embodiments, the processor 144 may function at least in part as a detector and may provide a switching signal to the switch 134. In some embodiments, the detector may be some type of hardware logic element or other circuit rather than the processor 144.

In some embodiments, the switching signal may be generated by the processor 144 as a control signal to control the switch 134 via the switching terminal 136. In some embodiments, the processor 144 may periodically, at a time interval that may be predetermined, sense a voltage at the GPIO terminal 146. In some embodiments, the processor 144 may generate the switching signal based at least in part on the sensed voltage. In some embodiments, the switching signal may be a digital signal having a first value when the sensed voltage indicates an open circuit at DC frequency between the RF contact pad 130 and the ground contact pad 132, and a second value when the sensed voltage indicates a short circuit at DC frequency between the RF contact pad 130 and the ground contact pad 132 such that the switch 134 will switch to use of the detachable antenna 128 when a short circuit at DC frequency is indicated, and will switch to use of the integrated multi-band antenna 116 when an open circuit at DC frequency is indicated.

In other embodiments, processor 144 may simply forward a detection notification signal to the switch 134 and the switch 134 may include additional circuitry such that the switch 134 switches from use of the multi-band antenna 116 to use of the detachable antenna 128 for GNSS reception only based in part on the detection notification signal rather than being controlled entirely by a switching signal. For example, in some embodiments, the switch 134 may include a delay circuit such that switchover to the detachable antenna 128 occurs after a predetermined delay to better ensure that the detachable antenna 128 has been properly seated and is not still being manipulated by a user before switchover occurs. In contrast, the switch, 134 may respond immediately to a notification that the detachable antenna 128 has been removed. In other embodiments, the processor 144 may include the delay before sending the switching signal to the switch 134 and/or may perform other signal processing or logic before generating and/or sending the switching signal.

In some embodiments, the method 200 may also include switching from use of the detachable GNSS reception antenna to the integrated multi-band antenna for GNSS signal reception in response to detection of a change from the connected state to the unconnected state at the block 204. In various embodiments, the switching signal provided to the switch 134 for switching from use of the detachable GNSS reception antenna to use of the integrated multi-band antenna for GNSS signal reception may be provided in one of the ways discussed above with respect to switching from use of the integrated multi-band antenna to use of the detachable antenna, or in some other manner. In various embodiments, the integrated multi-band antenna may remain available for use in local radio frequency (RF) communication by the wearable electronic device before, during, and after switching the GNSS antenna used at the block 204. In some embodiments, the method 200 may include performing other actions at a block 206.

Figure 3:
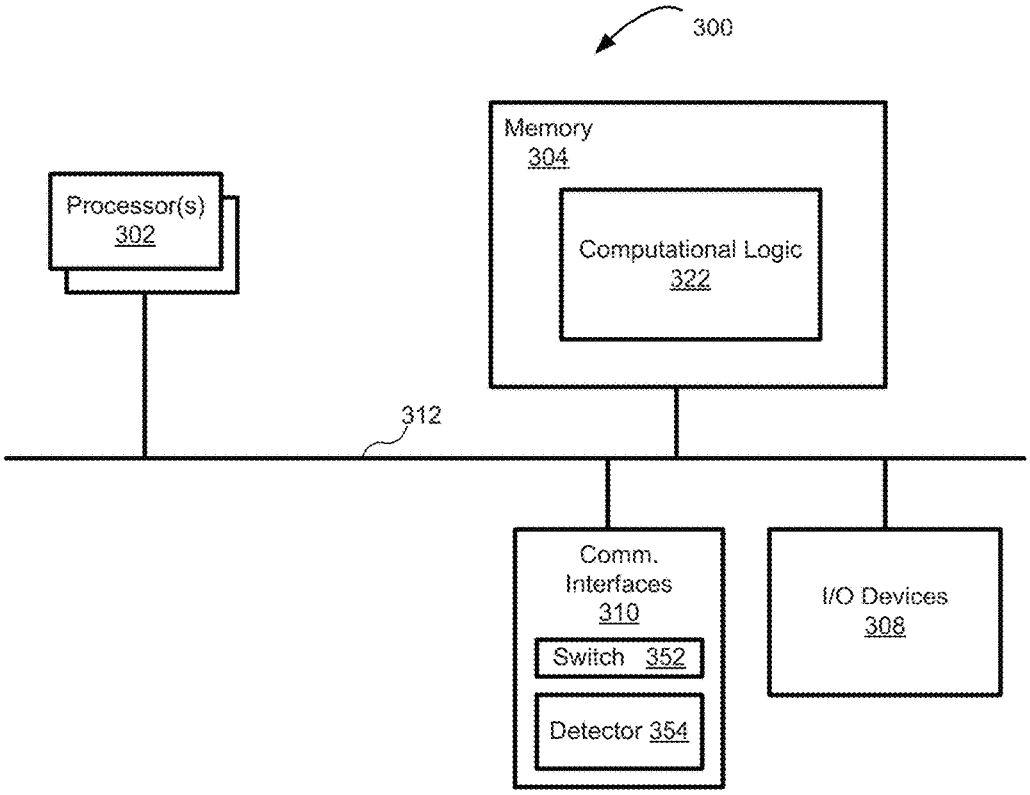
FIG. 3 schematically illustrates an example computer device to detect a change in connection state of a detachable GNSS antenna and direct a switch based at least in part on the detected change, according to various embodiments.

FIG. 3 illustrates an example computer device 300 that may include components corresponding to and/or implementing various components and methods of FIGS. 1-2, such as wearable electronic device 100 with processor 144 and switch 134, described with respect to FIG. 1, in accordance with various embodiments. In various embodiments, the computer device 300 may be a wearable electronic device configured in similar fashion to the wearable electronic device of FIG. 1. As shown, computer device 300 may include one or more processors 302, each having one or more processor cores, and system memory 304. The processor 302 may include any type of processors, single or multi-core microprocessors, and the like. The processor 302 may be implemented as an integrated circuit. In general, system memory 304 may be temporal and/or persistent storage of any type, including, but not limited to, volatile and non-volatile memory, optical, magnetic, and/or solid state storage, and so forth. Volatile memory may include, but is not limited to, static and/or dynamic random access memory. Non-volatile memory may include, but is not limited to, electrically erasable programmable read-only memory, phase change memory, resistive memory, and so forth.

The computer device 300 may further include input/output devices 308 (such as a display (e.g., a touchscreen display), keyboard, cursor control, remote control, gaming controller, image capture device, and so forth) and communication interfaces 310 (such as modems, infrared receivers, radio receivers (e.g., Bluetooth), and so forth). In some embodiments, the communications interfaces 310 may also include a switch 352 and a detector 354. In various embodiments, the switch 352 may be configured similarly to switch 134, and/or the detector 354 may be configured similarly to the processor 144 described with respect to FIG. 1. In some embodiments, the switch 352 and/or the detector 354 may be coupled with other components of the computer device 300 and/or may not be included within the communications interfaces 310.

The communication interfaces 310 may include communication chips (not shown) that may be configured to operate the computer device 300 in accordance with a Global System for Mobile Communication (GSM), General Packet Radio Service (GPRS), Universal Mobile Telecommunications System (UMTS), High Speed Packet Access (HSPA), Evolved HSPA (E-HSPA), or Long-Term Evolution (LTE) network. The communication chips may also be configured to operate in accordance with Enhanced Data for GSM Evolution (EDGE), GSM EDGE Radio Access Network (GERAN), Universal Terrestrial Radio Access Network (UTRAN), or Evolved UTRAN (E-UTRAN). The communication chips may be configured to operate in accordance with Code Division Multiple Access (CDMA), Time Division Multiple Access (TDMA), Digital Enhanced Cordless Telecommunications (DECT), Evolution-Data Optimized (EV-DO), derivatives thereof, as well as any other wireless protocols that are designated as 3G, 4G, 5G, and beyond. The communication interfaces 310 may operate in accordance with other wireless protocols in other embodiments.

The above-described computer device 300 elements may be coupled to each other via system bus 312, which may represent one or more buses. In the case of multiple buses, they may be bridged by one or more bus bridges (not shown). Each of these elements may perform its conventional functions known in the art. In particular, system memory 304 may be employed to store a working copy and a permanent copy of the programming instructions, such as drivers, for the operation of various components of computer device 300, including but not limited to operation of the wearable electronic device 100 of FIG. 1, the processor 144 of FIG. 1, the other components 154 of FIG. 1, an operating system of computer device 300, and/or one or more applications, collectively referred to as computational logic 322. The various elements may be implemented by assembler instructions supported by processor(s) 302 or high-level languages that may be compiled into such instructions.

The permanent copy of the programming instructions may be placed into system memory 304 in the factory or in the field through, for example, a distribution medium (not shown), or through communication interface 310 (from a distribution server (not shown)). That is, one or more distribution media having an implementation of the agent program may be employed to distribute the agent and to program various computing devices. The number, capability, and/or capacity of the elements 308, 310, 312 may vary. Their constitutions are otherwise known, and accordingly will not be further described.

For some embodiments, at least one of processors 302 may be packaged together with all or portions of computational logic 322 configured to facilitate aspects of embodiments described herein to form a System in Package (SiP) or a System on Chip (SoC).

The computer device 300 may include, be, or otherwise be associated with a wearable electronic device that may include components and/or implement methods described with respect to FIGS. 1-2, such as the wearable electronic device 100, the processor 144, the other components 154, and/or the method 200 as described above. In some embodiments, one or more components such as processor 302, memory 304, and/or computational logic 322 may be included as a part of the wearable electronic device 100.

Figure 4:
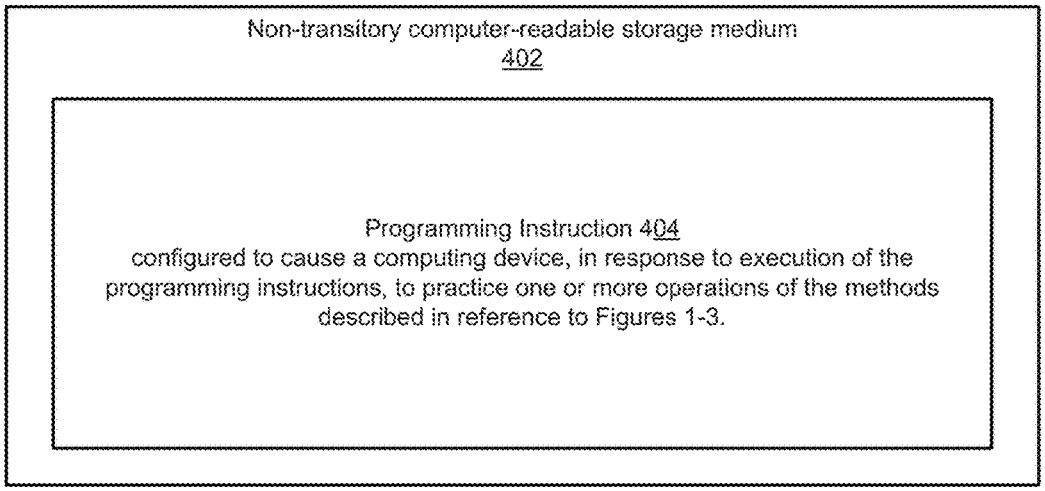
FIG. 4 illustrates an example storage medium with instructions configured to enable an apparatus to practice various aspects of the present disclosure, in accordance with various embodiments.

FIG. 4 illustrates example computer-readable storage medium 402 having instructions configured to practice all or selected ones of the operations associated with the computer device 300, earlier described with respect to FIG. 3; the wearable electronic device 100, the processor 144, and/or the other components 154 of FIG. 1; and/or the method of FIG. 2, in accordance with various embodiments. As illustrated, computer-readable storage medium 402 may include a number of programming instructions 404. The storage medium 402 may represent a broad range of non-transitory persistent storage medium known in the art, including but not limited to flash memory, dynamic random access memory, static random access memory, an optical disk, a magnetic disk, etc. Programming instructions 404 may be configured to enable a device, e.g., computer device 300, wearable electronic device 100, processor 144, and/or other components 154 in response to execution of the programming instructions 404, to perform, e.g., but not limited to, various operations described for the processor 144, and/or the other components 154 shown in FIG. 1, the computer device 300 of FIG. 3, or operations shown in process 200 of FIG. 2. In alternate embodiments, programming instructions 404 may be disposed on multiple computer-readable storage media 402. In alternate embodiment, storage medium 402 may be transitory, e.g., signals encoded with programming instructions 404.

Referring back to FIG. 3, for an embodiment, at least one of processors 302 may be packaged together with memory having all or portions of computational logic 322 configured to practice aspects described for the processor 144 and/or the other components 154 of the wearable electronic device 100 shown in FIG. 1, or operations shown in process 200 of FIG. 2. For an embodiment, at least one of processors 302 may be packaged together with memory having all or portions of computational logic 322 configured to practice aspects described for the processor 144 and/or the other components 154 of the wearable electronic device 100 shown in FIG. 1, or operations shown in process 200 of FIG. 2 to form a System in Package (SiP). For an embodiment, at least one of processors 302 may be integrated on the same die with memory having all or portions of computational logic 322 configured to practice aspects described for the processor 144 and/or the other components 154 of the wearable electronic device 100 shown in FIG. 1, or operations shown in process 200 of FIG. 2. For an embodiment, at least one of processors 302 may be packaged together with memory having all or portions of computational logic 322 configured to practice aspects of the processor 144 and/or the other components 154 of the wearable electronic device 100 shown in FIG. 1, or operations shown in process 200 of FIG. 2 to form a System on Chip (SoC). For at least one embodiment, the SoC may be utilized in, e.g., but not limited to, a mobile computing device such as a wearable device.

Machine-readable media (including non-transitory machine-readable media, such as machine-readable storage media), methods, systems and devices for performing the above-described techniques are illustrative examples of embodiments disclosed herein. Additionally, other devices in the above-described interactions may be configured to perform various disclosed techniques.

EXAMPLES

Example 1 may include a wearable electronic apparatus comprising: a multi-band antenna to receive satellite positioning signals in a first frequency band and local radio frequency (RF) communication signals in a second frequency band; an antenna connector to optionally receive a detachable satellite positioning antenna; and a switch having a switching terminal, a first input terminal coupled with the multi-band antenna, a second input terminal coupled with the antenna connector, and an output terminal; wherein the switch is to selectively connect the first input terminal or the second input terminal to the output terminal, in response to a state of a switching signal received at the switching terminal.

Example 2 may include the subject matter of Example 1, further comprising a detector coupled with the switching terminal of the switch to detect whether the detachable satellite positioning antenna is attached to the antenna connector and generate the switching signal to control the switch, based at least in part on a result of the detection.

Example 3 may include the subject matter of Example 2, wherein the detector includes a processor having a general purpose input/output (GPIO) terminal coupled with the antenna connector, wherein the processor is to generate the switching signal.

Example 4 may include the subject matter of any one of Examples 2-3, further comprising a radio frequency (RF) filter having an RF filter input terminal coupled with the antenna connector and an RF filter output terminal coupled with the detector, wherein the RF filter is to filter a signal received at the antenna connector to provide a filtered signal at the RF filter output terminal.

Example 5 may include the subject matter of any one of Examples 1-4, wherein the switching signal has a first state when the detachable antenna is attached to the antenna connector and a second state when the detachable antenna is not attached to the antenna connector, wherein the switch is to connect the first input terminal to the output terminal when the switching signal has the first state and connect the second input terminal to the output terminal when the switching signal has the second state.

Example 6 may include the subject matter of any one of Examples 1-5, wherein the antenna connector includes an RF contact pad and a ground contact pad.

Example 7 may include the subject matter of any one of Examples 1-6, further comprising a frequency domain multiplexer coupled with the multi-band antenna at a first port to multiplex signals from the first frequency band to a second port and signals from the second frequency band to a third port, wherein the first input terminal of the switch is coupled with the second port of the frequency domain multiplexer.

Example 8 may include the subject matter of any one of Examples 1-7, wherein the local RF communication signals include at least one of Bluetooth or WiFi communication signals.

Example 9 may include the subject matter of any one of Examples 1-8, wherein the wearable electronic apparatus is a wrist-worn wearable electronic apparatus and the detachable satellite positioning antenna is included in a detachable wrist band for the wrist-worn wearable electronic apparatus.

Example 10 may include a method comprising: detecting, by a wearable electronic device, a change in a connection state of a detachable global navigation satellite system (GNSS) reception antenna to an antenna connector on the wearable device; and switching, by the wearable electronic device, from use of an integrated multi-band antenna for GNSS signal reception to use of the detachable GNSS reception antenna for GNSS signal reception in response to detection of a change from an unconnected state to a connected state, or switching from use of the detachable GNSS reception antenna to the integrated multi-band antenna for GNSS signal reception in response to detection of a change from the connected state to the unconnected state, wherein the integrated multi-band antenna remains available for use in local radio frequency (RF) communication by the wearable electronic device before, during, and after switching the GNSS antenna used.

Example 11 may include the subject matter of Example 10, wherein local RF communication includes at least one of Bluetooth or WiFi communication.

Example 12 may include the subject matter of any one of Examples 10-11, wherein the wearable electronic device is a wrist-worn wearable electronic device and the detachable GNSS reception antenna is included in a detachable wrist band for the wrist-worn wearable electronic device.

Example 13 may include the subject matter of any one of Examples 10-12, further comprising filtering a signal from the antenna connector, wherein detecting the change in the connection state of the detachable GNSS reception antenna is based at least in part on the filtered signal.

Example 14 may include the subject matter of any one of Examples 10-13, wherein detecting, by the wearable electronic device, the change in the connection state of the detachable GNSS reception antenna includes receiving a signal at a general purpose input/output (GPIO) terminal of a processor, wherein the processor is to periodically determine a current connection state of the detachable GNSS reception antenna based at least in part on the signal received at the GPIO terminal and generate a switch control signal based at least in part on the current connection state.

Example 15 may include the subject matter of any one of Examples 10-14, wherein switching from use of the integrated multi-band antenna to use of the detachable GNSS reception antenna includes removing a connection of a first RF signal path to a GNSS circuit having a GNSS sensor and connecting a second RF signal path to the GNSS circuit, wherein the first RF signal path is from a frequency domain multiplexer coupled with the integrated multi-band antenna and the second RF signal path is from the antenna connector.

Example 16 may include the subject matter of any one of Examples 10-15, wherein the detachable GNSS reception antenna is a single band GNSS antenna having two connection points.

Example 17 may include the subject matter of Example 16, wherein the antenna connector includes an RF contact pad and a ground pad, and detecting a change from an unconnected state to a connected state of the detachable GNSS reception antenna includes detecting a change from an open circuit at direct current (DC) frequency between the RF contact pad and the ground pad to a short circuit at DC frequency between the RF contact pad and the ground pad.

Example 18 may include one or more computer-readable media comprising instructions that cause a wearable computer device, in response to execution of the instructions by the wearable computer device, to: a connection state of a detachable global navigation satellite system (GNSS) reception antenna to an antenna connector on the wearable computer device; and generate a switch control signal based at least in part on the detected connection state of the detachable GNSS reception antenna, wherein the switch control signal is to direct a switch to connect a first radio frequency (RF) signal path from an integrated multi-band antenna to a switch output terminal for GNSS signal reception when the detachable GNSS reception antenna is detected to be in an unconnected state and to connect a second RF signal path from the antenna connector to the switch output terminal for GNSS signal reception when the detachable GNSS reception antenna is detected to be in a connected state, wherein the wearable computer device is to use the integrated multi-band antenna for local RF communication regardless of the detected connection state of the detachable GNSS reception antenna.

Example 19 may include the subject matter of Example 18, wherein local RF communication includes at least one of Bluetooth or WiFi communication.

Example 20 may include the subject matter of any one of Examples 18-19, wherein the wearable computer device is a wrist-worn wearable computer device and the detachable GNSS reception antenna is included in a detachable wrist band for the wrist-worn wearable computer device.

Example 21 may include the subject matter of any one of Examples 18-20, wherein the instructions are to cause the wearable computer device to detect the connection state of the detachable GNSS reception antenna based at least in part on a signal received at a general purpose input/output (GPIO) terminal of a processor.

Example 22 may include the subject matter of Example 21, wherein the signal received at the GPIO terminal is a signal from an antenna connector that has been filtered by an RF filter.

Example 23 may include the subject matter of Example 22, wherein the antenna connector includes an RF contact pad and a ground pad.

Example 24 may include the subject matter of any one of Examples 18-23, wherein the switch is a single-pole double-throw RF switch.

Example 25 may include the subject matter of any one of Examples 18-24, wherein the switch is to connect the first RF signal path to a GNSS circuit having a GNSS sensor when the detachable GNSS reception antenna is detected to be in an unconnected state and connect the second RF signal path to the GNSS circuit when the detachable GNSS reception antenna is detected to be in a connected state, wherein the first RF signal path is from a frequency domain multiplexer coupled with the multi-band antenna and the second RF signal path is from the antenna connector.

Example 26 may include a wearable electronic device comprising: means for detecting a change in a connection state of a detachable global navigation satellite system (GNSS) reception antenna to an antenna connector on the wearable device; and means for switching from use of an integrated multi-band antenna for GNSS signal reception to use of the detachable GNSS reception antenna for GNSS signal reception in response to detection of a change from an unconnected state to a connected state, or switching from use of the detachable GNSS reception antenna to the integrated multi-band antenna for GNSS signal reception in response to detection of a change from the connected state to the unconnected state, wherein the integrated multi-band antenna remains available for use in local radio frequency (RF) communication by the wearable electronic device before, during, and after switching the GNSS antenna used.

Example 27 may include the subject matter of Example 26, wherein local RF communication includes at least one of Bluetooth or WiFi communication.

Example 28 may include the subject matter of any one of Examples 26-27, wherein the wearable electronic device is a wrist-worn wearable electronic device and the detachable GNSS reception antenna is included in a detachable wrist band for the wrist-worn wearable electronic device.

Example 29 may include the subject matter of any one of Examples 26-28, further comprising means for filtering a signal from the antenna connector, wherein the means for detecting the change in the connection state of the detachable GNSS reception antenna is to detect the change based at least in part on the filtered signal.

Example 30 may include the subject matter of any one of Examples 26-29, wherein the means for detecting the change in the connection state of the detachable GNSS reception antenna includes means for receiving a signal at a general purpose input/output (GPIO) terminal of a processor, wherein the processor is to periodically determine a current connection state of the detachable GNSS reception antenna based at least in part on the signal received at the GPIO terminal and generate a switch control signal based at least in part on the current connection state.

Example 31 may include the subject matter of any one of Examples 26-30, wherein the means for switching from use of the integrated multi-band antenna to use of the detachable GNSS reception antenna includes means for removing a connection of a first RF signal path to a GNSS circuit having a GNSS sensor and means for connecting a second RF signal path to the GNSS circuit, wherein the first RF signal path is from a frequency domain multiplexer coupled with the integrated multi-band antenna and the second RF signal path is from the antenna connector.

Example 32 may include the subject matter of any one of Examples 26-31, wherein the detachable GNSS reception antenna is a single band GNSS antenna having two connection points.

Example 33 may include the subject matter of Example 32, wherein the antenna connector includes an RF contact pad and a ground pad, and the means for detecting a change from an unconnected state to a connected state of the detachable GNSS reception antenna includes means for detecting a change from an open circuit at direct current (DC) frequency between the RF contact pad and the ground pad to a short circuit at DC frequency between the RF contact pad and the ground pad.

Various embodiments may include any suitable combination of the above-described embodiments including alternative (or) embodiments of embodiments that are described in conjunctive form (and) above (e.g., the "and" may be "and/or"). Furthermore, some embodiments may include one or more articles of manufacture (e.g., non-transitory computer-readable media) having instructions, stored thereon, that when executed result in actions of any of the above-described embodiments. Moreover, some embodiments may include apparatuses or systems having any suitable means for carrying out the various operations of the above-described embodiments.

Although certain embodiments have been illustrated and described herein for purposes of description, a wide variety of alternate and/or equivalent embodiments or implementations calculated to achieve the same purposes may be substituted for the embodiments shown and described without departing from the scope of the present disclosure. This application is intended to cover any adaptations or variations of the embodiments discussed herein. Therefore, it is manifestly intended that embodiments described herein be limited only by the claims.

Where the disclosure recites "a" or "a first" element or the equivalent thereof, such disclosure includes one or more such elements, neither requiring nor excluding two or more such elements. Further, ordinal indicators (e.g., first, second or third) for identified elements are used to distinguish between the elements, and do not indicate or imply a required or limited number of such elements, nor do they indicate a particular position or order of such elements unless otherwise specifically stated.

What is claimed is:

1. A wearable electronic apparatus comprising:

a multi-band antenna to receive satellite positioning signals in a first frequency band and local radio frequency (RF) communication signals in a second frequency band;

an antenna connector including an RF contact pad and a ground contact pad to couple to a detachable satellite positioning antenna, the detachable satellite positioning antenna detachable by a user to wear the wearable electronic apparatus, wherein when the detachable satellite positioning antenna is detached by the user, the RF contact pad is to indicate a change in impedance level at the RF contact pad;

a detector to detect the change in impedance level at the RF contact pad; and a switch having a switching terminal, a first input terminal coupled with the multi-band antenna, a second input terminal coupled with the antenna connector, and an output terminal; wherein the switch is to selectively connect the first input terminal or the second input terminal to the output terminal, in response to a state of a switching signal determined at least in part by the change in impedance level and received at the switching terminal.

2. The apparatus of claim 1, wherein the detector is coupled with the switching terminal of the switch to detect whether the detachable satellite positioning antenna is attached to the antenna connector and generate the switching signal to control the switch, based at least in part on a result of the detection.

3. The apparatus of claim 2, wherein the detector includes a processor having a general purpose input/output (GPIO) terminal coupled with the antenna connector, wherein the processor is to generate the switching signal.

4. The apparatus of claim 2, further comprising a radio frequency (RF) filter having an RF filter input terminal coupled with the antenna connector and an RF filter output terminal coupled with the detector, wherein the RF filter is to filter a signal received at the antenna connector to provide a filtered signal at the RF filter output terminal.

5. The apparatus of claim 1, wherein the switching signal has a first state when the detachable antenna is attached to the antenna connector and a second state when the detachable antenna is not attached to the antenna connector, wherein the switch is to connect the first input terminal to the output terminal when the switching signal has the first state and connect the second input terminal to the output terminal when the switching signal has the second state.

6. The apparatus of claim 1, further comprising a frequency domain multiplexer coupled with the multi-band antenna at a first port to multiplex signals from the first frequency band to a second port and signals from the second frequency band to a third port, wherein the first input terminal of the switch is coupled with the second port of the frequency domain multiplexer.

7. The apparatus of claim 1, wherein the local RF communication signals include at least one of Bluetooth or WiFi communication signals.

8. The apparatus of claim 1, wherein the wearable electronic apparatus is a wrist-worn wearable electronic apparatus and the detachable satellite positioning antenna is included in a detachable wrist band for the wrist-worn wearable electronic apparatus.

9. The apparatus of claim 1, wherein the detachable satellite positioning antenna is integrated into or serves as a securing component of the wearable electronic apparatus.

* * * * *